US006318629B1

(12) United States Patent
Anderson

(10) Patent No.: US 6,318,629 B1
(45) Date of Patent: Nov. 20, 2001

(54) SIGNAL DEVICE FOR MAILBOX

(76) Inventor: William B. Anderson, 1150 Warwick Furnace Rd., Glenmoore, PA (US) 19343

( * ) Notice: Subject to any disclaimer, the term of this patent is extended or adjusted under 35 U.S.C. 154(b) by 0 days.

(21) Appl. No.: 09/550,654

(22) Filed: Apr. 17, 2000

(51) Int. Cl.[7] ..... B65D 91/00
(52) U.S. Cl. ..... 232/35
(58) Field of Search ..... 232/35, 34, 17, 232/45; 116/215

(56) References Cited

U.S. PATENT DOCUMENTS

| | | | | |
|---|---|---|---|---|
| 2,098,242 | * | 11/1937 | Holmes | 232/35 |
| 2,421,603 | * | 6/1947 | Doppelhammer | 232/35 |
| 2,428,423 | | 10/1947 | Hurban . | |
| 2,609,787 | | 9/1952 | Lawson . | |
| 2,613,031 | | 10/1952 | Joyce . | |
| 3,143,287 | | 8/1964 | Holt . | |
| 3,343,784 | * | 9/1967 | Waldhaus et al. | 232/35 |
| 3,426,966 | | 2/1969 | Lay . | |
| 3,547,070 | * | 12/1970 | Schuh | 232/35 |
| 3,648,924 | | 3/1972 | Burns . | |
| 3,815,811 | * | 6/1974 | Harmon | 232/35 |
| 4,018,379 | | 4/1977 | Carter . | |
| 4,171,086 | * | 10/1979 | Hudson | 232/35 |
| 5,427,311 | | 6/1995 | Kachmar . | |
| 5,497,940 | | 3/1996 | Vogt . | |

* cited by examiner

*Primary Examiner*—B. Dayoan
*Assistant Examiner*—William L. Miller
(74) *Attorney, Agent, or Firm*—Schnader Harrison Segal & Lewis, LLP

(57) ABSTRACT

A mailbox includes a body and a door pivotally attached to the body. A signal device is attached to the mailbox by a connecting member. The signal device is secured in a number of positions between the door and body of the mailbox when the door is in a closed position and the signal device is unsupported and free to fall in a downward direction by gravity when the door is opened.

17 Claims, 2 Drawing Sheets

SIGNAL DEVICE FOR MAILBOX

BACKGROUND OF THE INVENTION

1. Field of the Invention

The present invention relates generally to mailboxes and more particularly to signal devices used for mailboxes to indicate whether there has been mail delivery and/or pickup.

2. Background of the Invention

Mailboxes have been utilized for many years for the delivery and pick up of mail. Mailboxes come in many different forms for both residential and commercial mail delivery. This invention supplements and improves on the most frequently used rural mailbox approved by the Postmaster General about 1916: A metal box with an oval top. A flag (red) is attached to the sidewall at the front and when raised to the vertical, alerts the carrier to mail removal. After removal of the outgoing mail and any required delivery, the carrier drops the flag back to horizontal the flag is then essentially not visible. When vertical the flag is difficult for the resident to see since it is at a right angle to the road, only one-eighth of an inch wide and frequently at substantial distance. A separate uniformly reliable indicator (flag) is needed to eliminate unnecessary trips, particularly in bad weather, and for busy or fragile residents. Many prior designs have attempted to meet this need.

The applicant has observed several deficiencies in the delivery signal devices currently used with mailboxes. Many signal devices are very difficult to see by the user due to the configuration of the signal device and/or the location of the signal device. Also, such signal devices are complex in design requiring a number of separate pieces, which results in a fragile design, and which also makes for difficulty of installation, repair and leakage problems. Also, many types of signal devices are seen to suffer from wear through use due to tension placed on the signal device as well as by the material used in manufacturing the signal device.

The present invention has been developed in view of the foregoing limitations to overcome the limitations in signal devices currently available for mailbox designs.

SUMMARY OF THE INVENTION

The present invention discloses a signal device for use with a mailbox. The signal device is attached by a flexible connecting member to the mailbox. The signal device is held in position between the mailbox and door. The signal device can be secured in a plurality of different positions between the door and mailbox. In use, as the door opens, the signal device is free to fall in a downward direction by gravity.

In accordance with the present invention, several embodiments of a signal device are described in detail herein. Other embodiments are also possible, but for the sake of brevity, they are not included in this application. As will be described in detail herein, there are several advantages attributed to the various disclosed embodiments, which are summarized below.

One advantage is a signal device of a more simplified design and which is easy to install.

Another advantage is a signal device that can be secured in a number of different locations on the mailbox, so that the signal device can be visible from various positions relative to the mailbox, by the resident.

Another advantage is that indicia can also be placed on the signal device which can be viewed by any individual passing the mailbox.

These and other advantages of the various embodiments will be become more readily apparent when taken together with the following description and attached drawings.

DETAILED DESCRIPTION OF THE PREFERRED EMBODIMENTS

Figure 5:
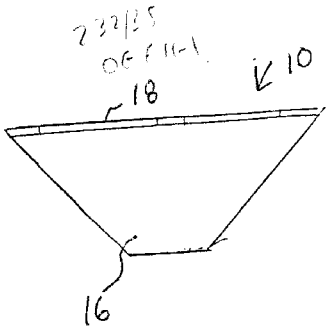
FIG. 5 is a top plan view of the signal device of FIG. 3.

Referring now to the drawings in detail, wherein like reference numerals indicate like elements throughout the several views, there is illustrated in FIGS. 1–5 an embodiment of a signal device in accordance with the present invention. In the illustrated embodiment, the signal device 10 is shown in combination with an embodiment of a mailbox 12. As will be described in detail herein, the signal device 10 is attached to the mailbox 12 by a connecting member 14, which preferably is flexible in property. The signal 10, mailbox 12 and connecting member 14 will be described in more detail in the following paragraphs.

Figure 4:
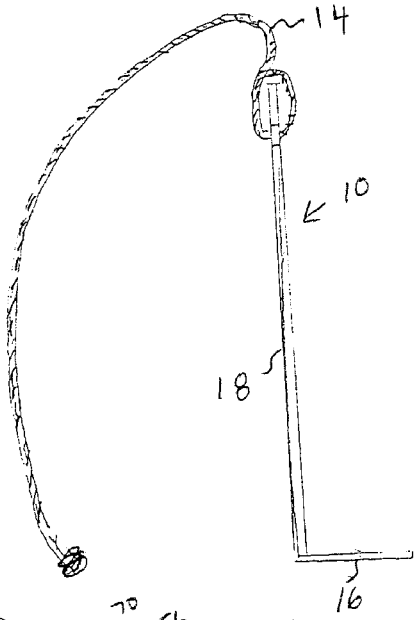
FIG. 4 is a side elevational view of the signal device of FIG. 3 shown attached with a connecting member.
Figure 3:
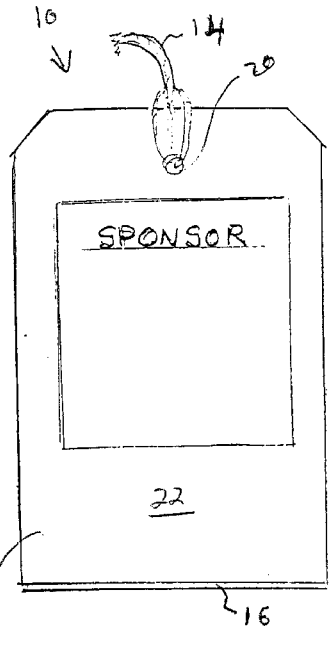
FIG. 3 is an isolated front elevational view of the signal device of FIG. 1.

The signal device 10 in accordance with the present embodiment defines at least a first wall 16 generally elongate along a first axis and preferably also a second wall 18 generally elongate along a second axis transverse the first axis and connected with the first wall 16. As illustrated in FIG. 4, the first wall 16 and second wall 18 in this embodiment are shown at approximately a 90° angle, however, it should be understood that the first wall 16 and second wall 18 can be provided at any desired angle. For example, in another embodiment not shown, the second wall 18 is positioned 102° from the first wall 16 for the purpose described below. As illustrated in FIG. 5, the first wall 16 defines a foot generally U-shaped in configuration by a taper at opposing ends. Although not shown, the foot can be provided in other configurations as well. As illustrated in FIG. 3, the second wall 18 is generally rectangular in configuration and includes opposing tapers at its upper end. Similar to the first wall 16, it should be understood that the second wall 18 can be provided in other configurations as well. The signal device 10 also includes means for connecting a first end of the connecting member 14 to the signal device 10. In this embodiment, the signal device 10 includes a through hole 20 which is best illustrated in FIG. 3 into which the connecting member 14 is received and tied. As should be understood, any conventional connecting means can be utilized for the same purpose, for example, the connecting member 14 can be secured by an adhesive to the signal device 10 or the signal device 10 can include a rivet or hook element attached to its surface to which the connecting member 14 is attached. In the present embodiment, the signal device 10 further includes indicia on at least one of its front and back surfaces. In the illustrated embodiment, indica is provided on the front surface identified by the word "SPONSOR". The term indicia is to be broadly construed to include any writing, symbols or combination of both, to name a few. Indicia can also be provided by any suitable means on the signal device 10, for example, indicia can be provided on a label attached to the signal 10 or the indicia can be formed directly on the surface of the signal device 10. In one embodiment, the indicia comprises advertising from a sponsor. The advertising can comprise, for example, a logo of a company or the name of an organization. Preferably the indicia on the signal device is sized so as to be legible to an individual having 20/20 vision from a distance of at least eight feet from the mailbox, however, as should be understood any size of indicia can be utilized where desired in accordance with the present embodiment. The signal device 10 is preferably comprised of a water proof material and is substantially rigid in construction. In one preferred embodiment, the signal device 10 is formed from stainless steel or aluminum, although any other suitable material and manufacturing process can be utilized for the same purpose.

Figure 1:
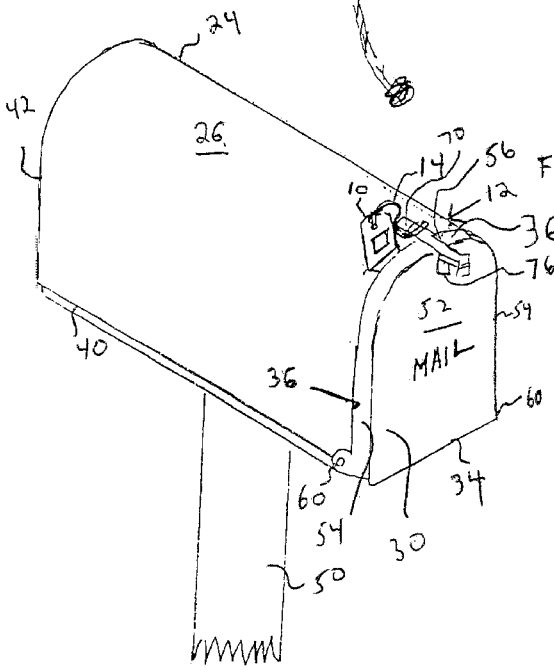
FIG. 1 is a perspective view illustrating a signal device in accordance with an embodiment of the present invention in combination with a mailbox and shown in a secured position between the mailbox body and door.
Figure 2:
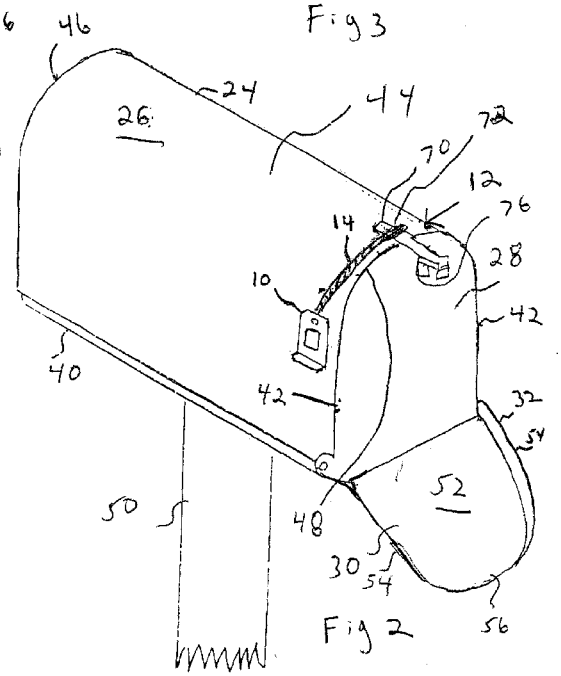
FIG. 2 is a perspective view of the signal device of claim 1, with the signal device shown in a released unsupported position.

The mailbox 12 as illustrated in FIGS. 1 and 2 in the present embodiment define a body 24 having an outer surface 26, a cavity 28 and a door 30 pivotally connected to the body 24 and sized to at least substantially cover and preferably entirely cover the cavity 28 in the closed position. The door 30 is illustrated in a closed position in FIG. 1 and in an open position in FIG. 2. The door 30 in the present embodiment includes a perimeter 32 defining a first area 34 and a second area 36. As illustrated in FIGS. 1 and 2, the door 30 is pivotally connected to the body 24 proximate the first area 34. Further, the second area 36 of the door 30 is positioned adjacent the outer surface 26 of the body 24 in the closed position of the door 30, as shown in FIG. 1. The body 24 and door 30 of the mailbox 12 can be of any desired configuration. In the illustrated embodiment, the body 24 of the mailbox 12 comprises a bottom wall 40, opposing side walls 42 attached with the bottom wall 40, an upper wall 44 connected with the opposing side walls 42, and a back wall 46 and a front wall 48, each connected with the bottom wall 40, opposing side walls 42 and upper wall 44. As illustrated in FIG. 2, the cavity 28 is provided within front wall 48 and extends in a direction of the back wall 46. The mailbox 12 can also be attached by any suitable means to a support member, such as a post 50 illustrated in FIGS. 1 and 2 and a conventional mounting bracket securing the mailbox 12 to the post 50 via a screw/nut combination.

The door 30 comprises a generally elongated back wall 52 defining a bottom surface, opposing side surfaces 54 and an upper surface 56. In the present embodiment, the second area 36 of door 30 comprises a substantially continuous lip connected with the opposing side surfaces 54 and upper surface 56. The substantially continuous lip is preferably continuous between first and second terminating ends 60 proximate first area 34 of door 30. Door 30 is preferably pivotally coupled to the body 24 by any suitable means, such as openings provided within the door 30 and body 24 into which is received a bolt secured by a nut. Another possible connecting member can be used for the same purpose. In the illustrated embodiment, opposing side walls 42 and upper wall 44 of the mailbox 12 define a substantially U-shaped cross-section comprising an arc proximate the upper wall 44. Similarly, in this embodiment, preferably the second area 36 of door 30 including the substantially continuous lip is shaped corresponding to the shape of the side walls 42 and upper wall 44 of the body 24. The mailbox 12 can be comprised of any suitable material and made from any of a variety of a different manufacturing processes, for example, the mailbox 12 can be formed of metal, such as stainless steel or aluminum, or plastic.

The connecting member 14 as indicated above is preferably flexible and more preferably comprises a cord of any desired length. That cord can be of any variety of suitable materials, such as cotton and more preferably nylon, to name a few. As indicated above, means are provided for attaching the connecting member 14 to the mailbox 12, although as should be understood, any suitable means can be provided for this purpose. In the present embodiment, the mailbox 12 includes an engagement member 70 attached to the body 24. The engagement member 70 includes an opening 72 provided between a lower surface of engagement member 70 and outer surface 26 of the body 24. The second end of the connecting member 14 is received within the opening 72 in the engagement member 70 and subsequently secured by any suitable means, such as tied. Similar to that discussed above with respect to the signal 10, any of a variety of different mechanisms can be provided to secure the second end of the connecting member 14 to the engagement member 70, or alternatively, secured directly to the mailbox body 24. In the present embodiment, the engagement member 70 further includes means for retaining door 30 when door 30 is in its closed position illustrated in FIG. 1. In the illustrated embodiment, the retaining means comprises a generally resilient projection 76 adapted to flex when force is applied to open or close door 30. In the closed position of door 30 shown in FIG. 1, the back wall 52 is positioned adjacent to and preferably engaging projection 76 to help retain door 30 in its closed position.

The use of the signal device 10 in connection with the mailbox 12 will now be described. As illustrated in FIG. 1, the signal device 10 is secured in a plurality of positions between the second area 36 of door 30 and the outer surface 26 of the body 24 when the door 30 is in the closed position. The signal device 10 is unsupported and free to fall in a downward direction by gravity when the door 30 is opened, as illustrated in FIG. 2. As illustrated in FIG. 1, the signal device 10 is retained by positioning the first wall or foot 16 between the outer surface 26 of the body 24 and the substantially continuous lip of the door 30. In the present embodiment, the signal device 10 can be positioned at any location extending between the first and second terminating ends 60 along the second area 36 of door 30.

As discussed above, the first and second walls 16 and 18 of the signal device 10 can be provided at any desired angle relative to one another. In embodiments where the angle is greater than 90 degrees, upon opening of the door 30, the angle of second wall 18 ensures that the signal device 10 falls in a backward direction toward the rear wall 46 of mailbox 12, which has the effect to keep the signal device 10 out of the way when the door 30 is closed, and also prevents the signal device 10 from intruding into the cavity space 28 in the body 24.

Figure 6:
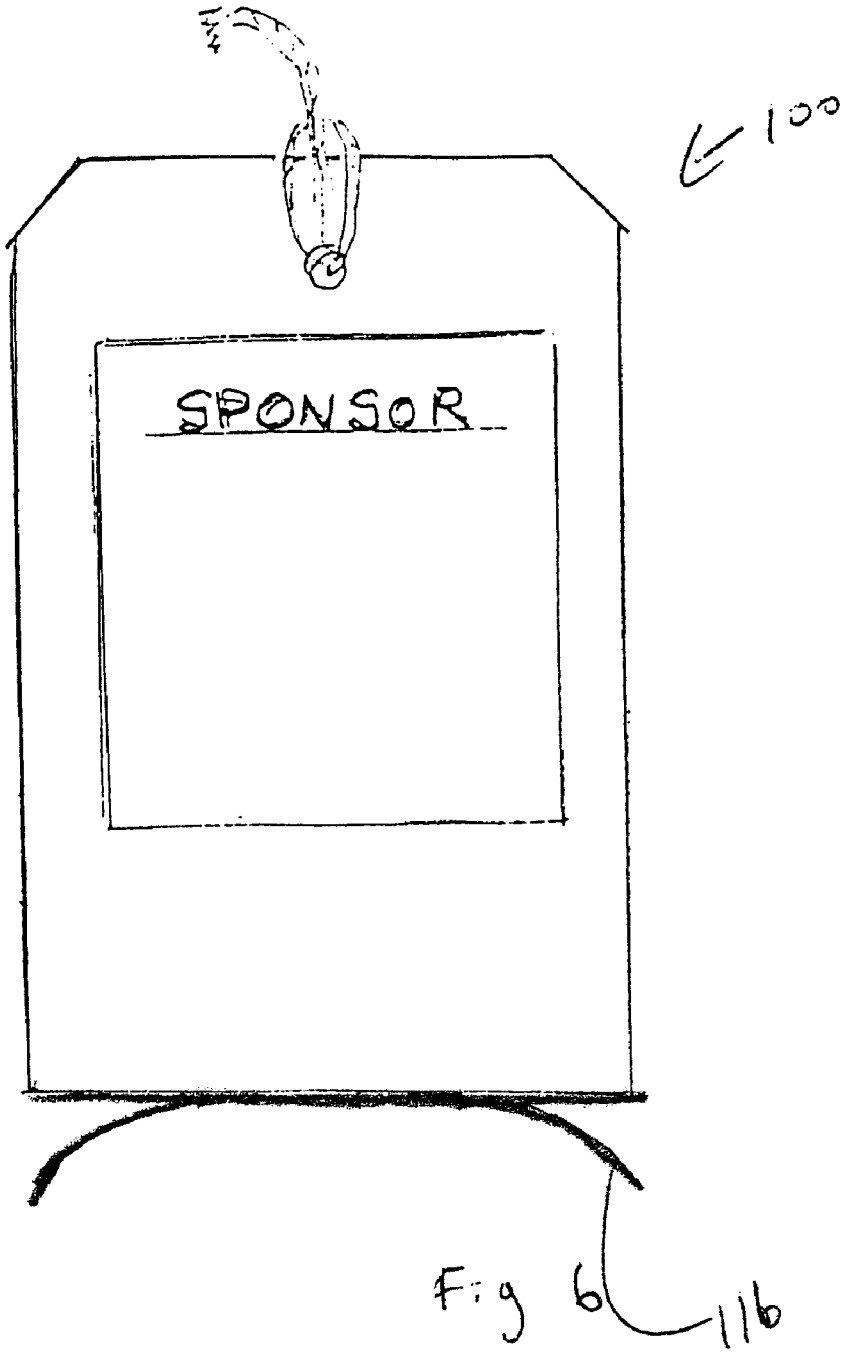
FIG. 6 is an isolated front elevational view of another embodiment of a signal device of FIG. 1.

Another embodiment of a signal device in accordance with the present invention is illustrated in FIG. 6. The signal device 100 illustrated in FIG. 6 is the same as the signal device 10 except for the first wall or foot 116. In this embodiment, the foot 116 is curved and preferably corresponds in shape to the arc defined by the opposing side walls and upper wall of body 24 illustrated in FIGS. 1 and 2. The shape of the foot 116 in this embodiment has the advantage that it allows for a strong retention when secured between door 30 and body 24 of mailbox 12. The signal device 100 similar to the signal device 10 can be made of any suitable material and of any variety of different manufacturing processes. In the illustrated embodiment, the signal device 100 is comprised of metal, such as stainless steel or aluminum, and the foot 116 is formed by first making cuts in the opposing sides, followed by bending of foot 116 forward and then providing the arc by bending the ends of the foot 116 toward one another. In this embodiment, as in the signal device 10, the surface of signal device 100 receiving the indicia is of any defined size, such as 2½ inches by 2½ inches in the present embodiment as an example.

As indicated above, there are several advantages to the various embodiments of the signal device described above. One advantage is that the signal device can be secured in a number of different locations on the mailbox, which allows for the signal device to be easily seen from a variety of different positions. For example, a mailbox may be located toward the right side of a residential property, so that it would be desirable to position the signal device on the left side of the mailbox to provide an optimal line of sight from the residence. Another advantage is that the signal device can be installed without tools. A further advantage is that the signal device can be secured in the various locations on the mailbox without penetration of the mailbox body, which prevents water leakage that can damage the contents. Still another advantage is that the signal device in use is not under any strain or tension, which increases the overall life of the device. Another advantage is that the signal device is easy to install and operate, requiring little or no skill or effort. Still another advantage is that the device includes minimal parts comprising the signal device and connecting member attached to the mailbox, which reduces the overall parts and accordingly the cost of the device. Also, a further advantage is that the limited number of parts are sufficiently strong and durable, which avoids the inherent fragility and maintenance requirements of multi-part devices. Still another advantage is that the signal device also has excellent visibility, and is easily adjusted to maintain visibility. Also, the signal device does not intrude on mail delivery. Another advantage is that the signal device includes the feature that visible advertising sponsorship or other indicia can be added to the device. Also, this indicia is clearly visible due to the positioning of the signal device on the mailbox when the door is closed and throughout at least daylight hours. Secondary lighting or flourescent indica can also be utilized to provide visibility during nighttime hours. In addition, the signal device is secured in a position in which the surface having the indicia thereon faces the street, which further facilitates visibility of the device.

It will be recognized by those skilled in the art that changes may be made by the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended claims.

What is claimed is:

1. In combination, a mailbox and signal device comprising:

said mailbox defining a body having an outer surface, a cavity in said outer surface and a door pivotally connected to said body and sized to substantially cover said cavity in a closed position, wherein said door includes a perimeter defining first and second areas adjacent said perimeter, wherein said door is pivotally connected to said body proximate said first area and said second area is positioned adjacent said outer surface of said body in said closed position of said door;

said signal device, said signal device defining at least a first wall generally elongate along a first axis and a second wall generally elongate along a second axis traverse said first axis and with said second wall being connected to said first wall, wherein a surface area of said second wall is larger in size than a surface area of said first wall; and a flexible connecting member attached proximate a first end to said mailbox and proximate a second end to said signal;

wherein said signal device is secured in a plurality of positions by said first wall positioned between said second area of said perimeter of said door and said outer surface of said body in said closed position of said door and said signal device is unsupported and free to fall in a downward direction by gravity when said door is opened, whereby said second wall of said signal is readily visible from various locations when the signal is positioned between the door and body in said closed position of said door, to signify that mail has not yet been delivered.

2. A combination mailbox and signal device of claim 1, wherein said door comprises a generally elongate back wall, with said back wall defining a bottom surface, opposing side surfaces and an upper surface, said second area of said door further comprises a substantially continuous lip defined by first and second terminating ends and with said lip connected with said opposing side surfaces and said upper surface, wherein said first wall of said signal device is secured between said lip and said outer surface of said body in a plurality of positions between said first and second terminating ends when said door is in the closed position.

3. A combination mailbox and signal device of claim 2, wherein said body of said mailbox comprises a bottom wall, a pair of opposing side walls attached with said bottom wall, an upper wall connected with said opposing side walls, and a back wall, each connected with said bottom wall, said opposing side walls and said upper wall, wherein said cavity is provided in a front portion and extends in a direction of said back wall, wherein said lip of said door in said closed position is positioned adjacent said opposing side walls and said upper wall of said body.

4. A combination mailbox and signal device of claim 3, wherein said flexible connecting member comprises a cord and said combination further comprises means for connecting said first end of said cord to said second wall of said signal device and means for connecting said second end of said cord to said mailbox.

5. A combination mailbox and signal device of claim 4, wherein said second wall of said signal device further comprises front and back surfaces, wherein at least one of said front and back surfaces includes indicia thereon.

6. A combination mailbox and signal device of claim 5, wherein said opposing side walls and said upper wall of said mailbox define a substantially u-shaped cross-section comprising an arc proximate said upper wall, and wherein said first wall of said signal defines a foot corresponding in configuration to said arc.

7. A combination mailbox and signal device of claim 6, wherein said means for connecting said first end of said cord to said second wall of said signal device comprises an opening in said second wall receiving said first end of said cord.

8. A combination mailbox and signal device of claim 7, wherein said means for connecting said second end of said cord to said mailbox comprises a engagement member attached with said body.

9. A combination mailbox and signal device of claim 8, wherein said engagement member comprises an opening receiving said second end of said cord, said engagement member further including means for retaining said door when said door is in the closed position.

10. A combination mailbox and signal device of claim 9, wherein said retaining means comprises a generally resilient projection engaging said back wall of said door.

11. A combination mailbox and signal device of claim 10, wherein said signal is comprised of a waterproof material and is substantially rigid, and said indicia is sized so as to be legible to a person having 20/20 vision from a distance of at least eight feet from said mailbox.

12. A combination mailbox and signal device of claim 1, wherein said surface areas of said first wall and second wall are defined by height multiplied by width.

13. A combination mailbox and signal device of claim 12, wherein said second wall of said signal further includes at least front and back surfaces, wherein at least one of said front and back surfaces includes indicia thereon, wherein the indicia comprises advertising from a sponsor.

14. A signal device adapted for a mailbox, said mailbox comprising a body having an outer surface defining a bottom wall, a pair of opposing side walls attached with said bottom wall, an upper wall connected with said opposing side walls, and a back wall, each connected with said bottom wall, said opposing side walls and said upper wall, wherein said body further includes a cavity in a front portion and extending in a direction of said back wall, said mailbox further comprising a door pivotally connected to said body and sized to substantially cover said cavity in a closed position, wherein said door includes a perimeter defining first and second areas adjacent said perimeter, said door defining a generally elongate back wall, with said back wall defining a bottom surface, opposing side surfaces and an upper surface, said door being pivotally connected to said body proximate said first area and said second area is positioned adjacent said outer surface of said body in said closed position of said door, wherein second area of said door further comprises a substantially continuous lip defined by first and second terminating ends and with said lip connected with said opposing side surfaces and said upper surface of said door, wherein said lip of said door in said closed position is positioned adjacent said opposing side walls and said upper wall of said body, said signal device comprising:

a first wall generally elongate along a first axis and defined by first and second ends;

a second wall generally elongate along a second axis transverse said first axis, said second wall defining first and second ends, and with said first end of said first wall connected to said second end of said second wall;

a flexible connecting member having a first end for being attached to said mailbox and a second end attached to said signal; and wherein said first wall of said signal device is adapted for being secured between said lip and said outer surface of said body in a plurality of positions between said first and second terminating ends of said lip when said door is in the closed position, and wherein said signal device is unsupported and free to fall in a downward direction by gravity when said door is opened;

wherein said mailbox further comprises an englargement member including an opening adopted for receiving said second end of said connecting member, said engagement member further including a generally resilient projection for retaining said door when said door is in the closed position;

wherein said flexible connecting member comprises a cord end said signal device further comprises means for connecting said first end of said cord to said second wall of said signal device;

wherein said second wall of said signal device further comprises front and back surfaces, wherein at least one of said front and back surfaces, wherein at least one of said front and back surfaces includes inidicia thereon, wherein said signal is comprised of a waterproof material and is substantially rigid, and said indicia is sized so as to be legible to a person having 20/20 vision from a distance of at least eight feet from said mailbox; and wherein said means for connecting said first end of said cord to said second wall of said signal device comprises an opening in said second wall receiving said first end of said cord.

15. A signal device of claim 14, wherein said opposing side walls and said upper wall of said mailbox define a substantially u-shaped cross-section comprising an arc proximate said upper wall, and wherein said first wall of said signal defines a foot adapted for corresponding in configuration to said arc.

16. A method for signaling the delivery of mail to a mailbox comprising the steps of:

providing said mailbox comprising a body having an outer surface, a cavity in said outer surface and a door pivotally connected to said body and sized to substantially cover said cavity in a closed position, wherein said door includes a perimeter defining first and second areas adjacent said perimeter, wherein said door is pivotally connected to said body proximate said first area and said second area is positioned adjacent said outer surface of said body in said closed position of said door;

wherein said body of said mailbox comprises a bottom wall, a pair of opposing side walls attached with said bottom wall, an upper wall connected with said opposing side walls. and a back wall, each connected with said bottom wall, said opposing side walls and said upper wall, wherein said cavity is provided in a front portion and extends in a direction of said back wall, wherein a lip of said door in said closed position is positioned adjacent said opposing side walls and said upper wall of said body;

providing a signal device connected by a flexible connecting member to said mailbox, said signal device defining a first wall generally elongate along a first axis and a second wall attached to said first wall and with said second wall generally elongate along a second axis transverse said first axis;

wherein said opposing side walls and said upper wall of said mailbox define a substantially u-shaped cross-section comprising an arc proximate said upper wall, and wherein said first wall of said signal defines a foot corresponding in configuration to said arc;

securing said signal device in a plurality of positions between said second area of said perimeter of said door and said outer surface of said body in said closed position of said door to signal that mail has not been delivered; and allowing said signal device to fall in a downward direction by gravity when said door is opened to signal that mail has been delivered.

17. A method according to claim 16 further comprising the step of:

providing indicia on a surface of said second wall of said signal.

* * * * *